US010850541B2

(12) United States Patent
Takahashi

(10) Patent No.: US 10,850,541 B2
(45) Date of Patent: Dec. 1, 2020

(54) PRINTER

(71) Applicants: CITIZEN WATCH CO., LTD., Tokyo (JP); CITIZEN SYSTEMS JAPAN CO., LTD., Tokyo (JP)

(72) Inventor: Akira Takahashi, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/816,548

(22) Filed: Mar. 12, 2020

(65) Prior Publication Data

US 2020/0324561 A1 Oct. 15, 2020

(30) Foreign Application Priority Data

Mar. 14, 2019 (JP) ..... 2019-047014

(51) Int. Cl.
*B41J 15/04* (2006.01)
*B65H 16/00* (2006.01)
*B41J 29/13* (2006.01)

(52) U.S. Cl.
CPC ..... *B41J 15/042* (2013.01); *B41J 29/13* (2013.01); *B65H 16/00* (2013.01)

(58) Field of Classification Search
CPC . B41J 15/042; B41J 15/04; B41J 29/13; B41J 11/04; B41J 11/48; B41J 13/00; B65H 16/00
See application file for complete search history.

(56) References Cited

U.S. PATENT DOCUMENTS 5,158,378 A * 10/1992 Takada ..... B41J 29/10 400/124.01
5,397,191 A * 3/1995 Murakami ..... B41J 3/28 400/624
6,082,912 A * 7/2000 Shimizu ..... B41J 23/025 400/120.01
6,155,728 A * 12/2000 Sakaino ..... B41J 11/04 400/26

(Continued)

FOREIGN PATENT DOCUMENTS

JP 2002-128311 5/2002
JP 2009-234163 10/2009

(Continued)

*Primary Examiner* — Michael E Gallion
(74) *Attorney, Agent, or Firm* — Wenderoth, Lind & Ponack, L.L.P.

(57) ABSTRACT

A printer includes a first cam that is configured to change a distance between a pair of rollers, i.e. a drive roller and a pinch roller, wherein the pair of rollers are disposed opposite to each other with a paper therebetween and at least one of the rollers is configured to feed the paper along a transfer path by its rotation, a second cam that is configured to change a distance between a head for printing on the paper and a platen roller, wherein the head and the platen roller are disposed opposite to each other with the paper therebetween, and a third cam that is configured to switch the transfer path for the paper to a discharging transfer path or a decurl transfer path that are formed as different transfer paths. The first cam, the second cam, and the third cam are connected to a same rotation axis.

3 Claims, 13 Drawing Sheets

(56) References Cited

U.S. PATENT DOCUMENTS

| | | | | |
|---|---|---|---|---|
| 8,827,440 | B2 * | 9/2014 | Inokuchi | B41J 11/70<br>347/104 |
| 10,730,323 | B2 * | 8/2020 | Harigae | B41J 15/04 |
| 2011/0081189 | A1 * | 4/2011 | Okuno | B41J 11/0005<br>400/619 |

FOREIGN PATENT DOCUMENTS

| | | |
|---|---|---|
| JP | 2015-189204 | 11/2015 |
| JP | 2017-94537 | 6/2017 |

* cited by examiner

SECT.A-A

SECT.B-B

SECT.C-C

PRINTER

CROSS-REFERENCE TO RELATED APPLICATION

This application is based upon and claims the benefit of priority from Japanese patent application No. 2019-047014 filed on Mar. 14, 2019, the entire disclosure of which is incorporated herein by reference.

BACKGROUND ART

The present disclosure relates to a printer.

A printer which prints on a roll paper is known in the art. The roll paper is formed from a long strip paper wound in a roll. Such a printer includes a printing process for printing while feeding the paper and a feeding process for feeding the paper without printing.

Specifically, the thermal transfer printer includes a sublimation type thermal transfer printer which sublimates the ink to attach it to the paper. The sublimation type thermal transfer printer can achieve the printed object or material with gradation like a photograph. However, when performing color printing with a plurality of colors of ink, the printing process and the feeding process are repeated multiple times by changing the colors of the ribbons.

First, the printing process is performed to print in yellow (Y) while feeding the paper and then the feeding process is performed to feed the paper in a direction opposite to the direction in the printing process. Next, the printing process is performed to print in magenta (M) on the paper which has been printed in yellow, and then the feeding process is performed to feed the paper in the direction opposite to the direction in the printing process. Next, the printing process is performed to print in cyan (C) on the paper which has been printed in yellow and magenta. Finally, the paper which has been printed in yellow, magenta, and cyan is ejected to the outside.

In the printer which performs the printing process and the feeding process, the tip or leading end of the paper enters or exits from an ejection port. The leading end of the paper extending through the ejection port may be pinched or grabbed in the middle of printing and consequently, the print position may be misaligned.

Considering the above issue, a printer including, as transfer paths for the paper, a general transfer path (first transfer path), and a second transfer path is known in the art (see JP 2015-189204A, for example). The first transfer path is continuous to the ejection port and the second transfer path prevents the leading end of the paper extending through the ejection port. In this printer, the paper is transferred or fed along the second transfer path during the printing, and the paper is transferred or fed along the first transfer path to eject the paper after the printing is finished.

A flap which changes its posture is used to switch the transfer path. The posture of the flap is changed by a motor and thereby the transfer path to be used is switched to the first transfer path or the second transfer path.

In addition to the change of the flap posture, the printer has to change a distance between a platen roller and a printing head portion as well as a distance between transfer rollers for transferring the paper.

Further, drive sources such as motors are required to change the flap posture and the distances between the rollers. Providing a drive source for each component to be switched or changed increases cost and takes up more spaces.

The present disclosure is made considering the above issues and an object of the present disclosure is to provide a printer capable of reducing an installation space and cost thereof.

SUMMARY

The present disclosure relates to a printer including a first cam that is configured to change a distance between a pair of rollers that are provided opposite to each other with a paper therebetween, wherein at least one of the pair of rollers is configured to feed the paper along a transfer path by its rotation, a second cam that is configured to change a distance between a printing head portion for printing on the paper and a platen roller that is provided opposite to the printing head portion with the paper therebetween, and a third cam that is configured to switch the transfer path for the paper to one of a first transfer path and a second transfer path that are formed as different transfer paths. The first cam, the second cam, and the third cam are connected to a same rotation axis. The first transfer path is a transfer path continuous to an ejection port for ejecting the paper outside, and the second transfer path is a decurl transfer path for uncurling or decurling to reduce a curl of the paper. The first cam is further configured to switch the printer between the feedable state where the pair of rollers contact each other and the unfeedable state where the pair of rollers are separated from each other. The second cam is further configured to switch the printer between a printable state where the printing head portion and the platen roller contact each other and an unprintable state where the printing head portion and the platen roller are separated from each other. The printer further includes a printing process for feeding the paper and printing on the paper, a feeding process for feeding the paper without printing on the paper, a decurling process for feeding the paper to the second transfer path, and a waiting process before printing on the paper not to feed the paper. The first cam, the second cam, and the third cam are provided in accordance with a rotational angle of the rotation axis such that in the printing process, the first cam switches the printer to the feedable state, the second cam switches the printer to the printable state, and the third cam switches the transfer path to the first transfer path, in the feeding process, the first cam switches the printer to the feedable state, the second cam switches the printer to the unprintable state, and the third cam switches the transfer path to the first transfer path, in the decurling process, the first cam switches the printer to the feedable state, the second cam switches the printer to the unprintable state, and the third cam switches the transfer path to the second transfer path, and in the waiting process, the first cam switches the printer to the unfeedable state, the second cam switches the printer to the unprintable state, and the third cam switches the transfer path to the first transfer path or the second transfer path.

DETAILED DESCRIPTION

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

Hereinafter, an embodiment of the present disclosure will be described with reference to drawings.

Figure 1:
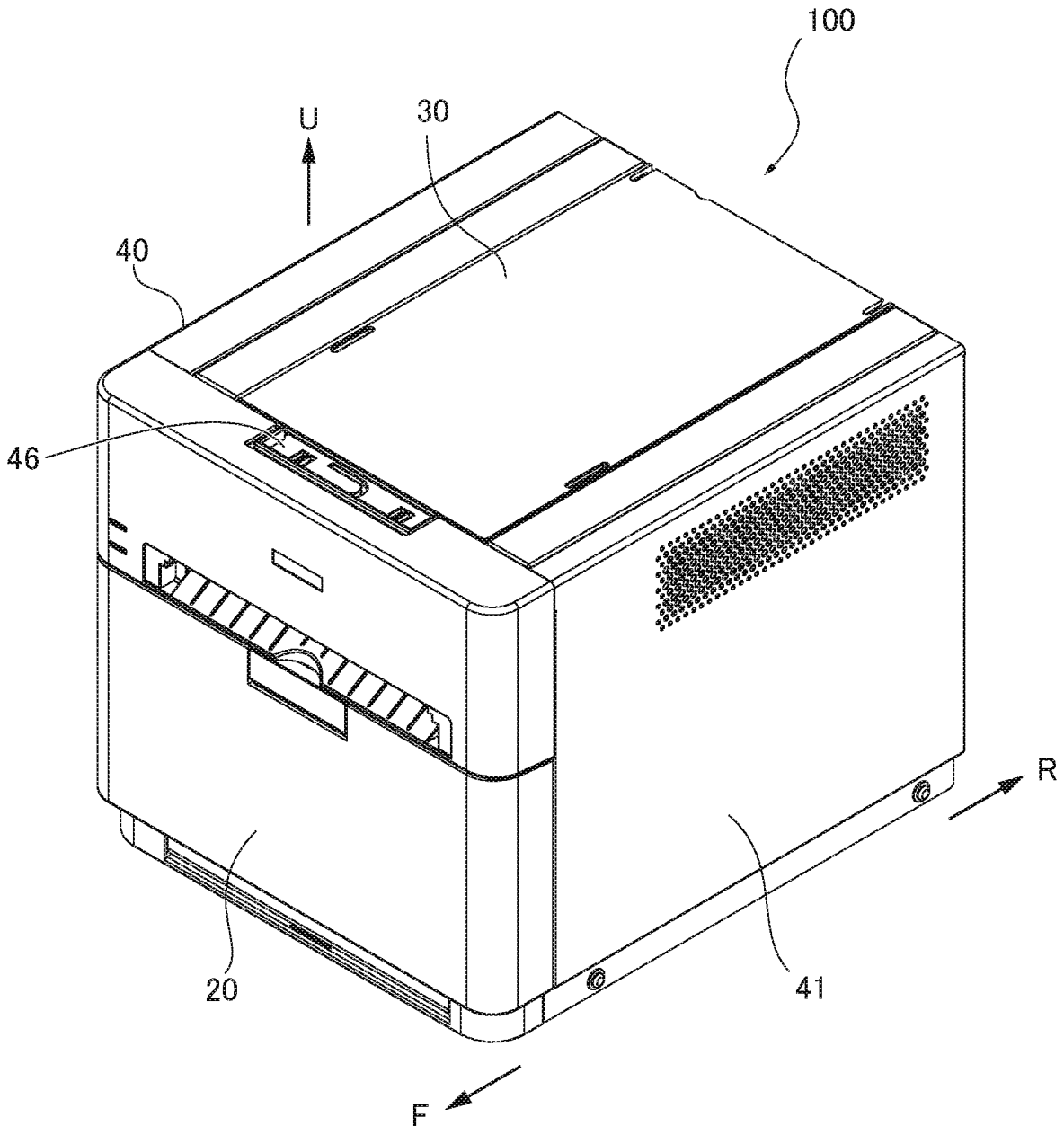
FIG. 1 is a perspective view illustrating a sublimation type thermal transfer printer which is an embodiment of a printer according to the present disclosure.
Figure 2:
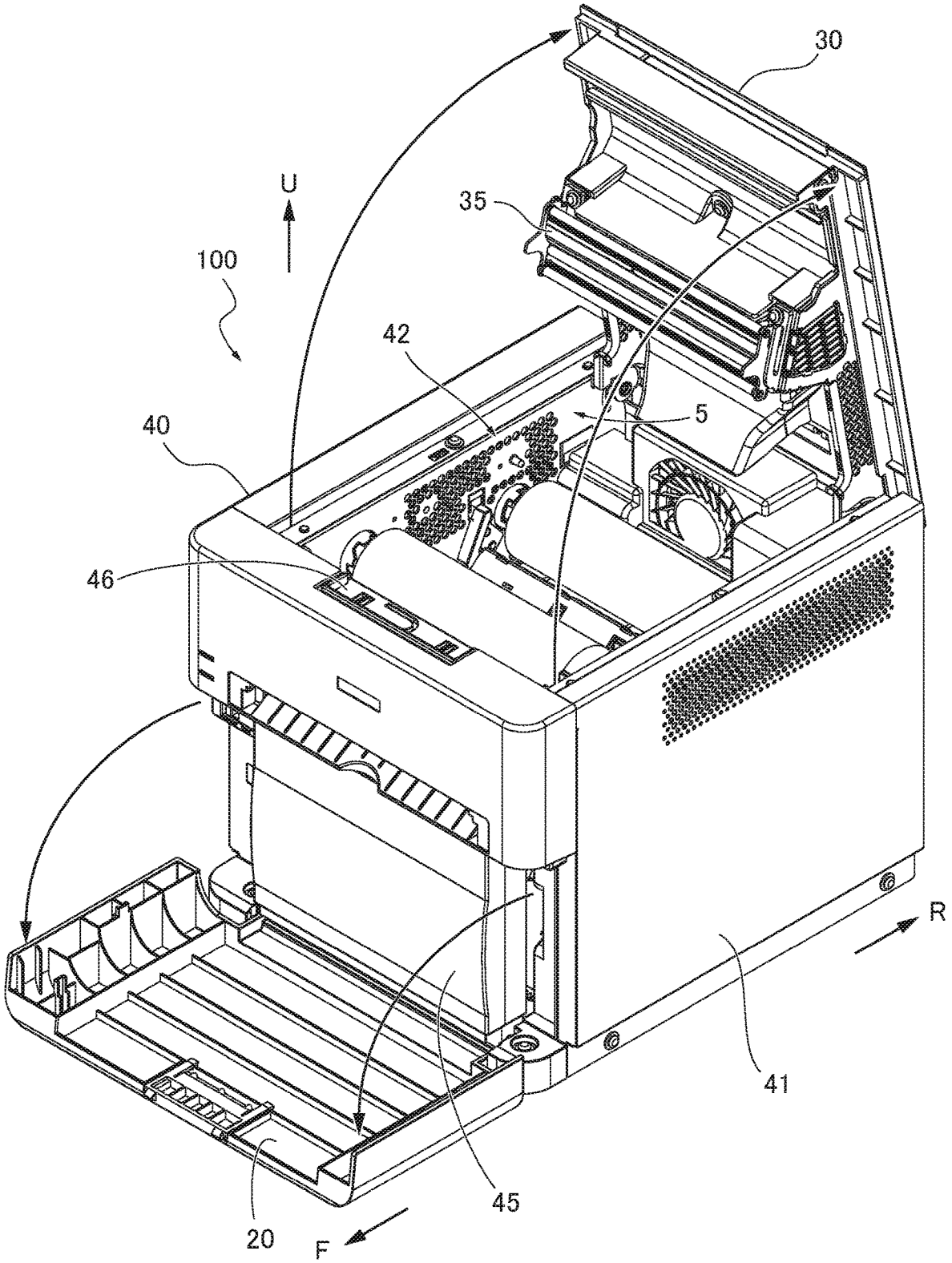
FIG. 2 is a perspective view illustrating the printer shown in FIG. 1 when a front cover and a top cover are open.

FIG. 1 is a perspective view illustrating a sublimation type thermal transfer printer 100 which is an embodiment of a printer according to the present disclosure. FIG. 2 is a perspective view illustrating the printer 100 shown in FIG. 1 when a front cover 20 and a top cover 30 are open.

Figure 3:
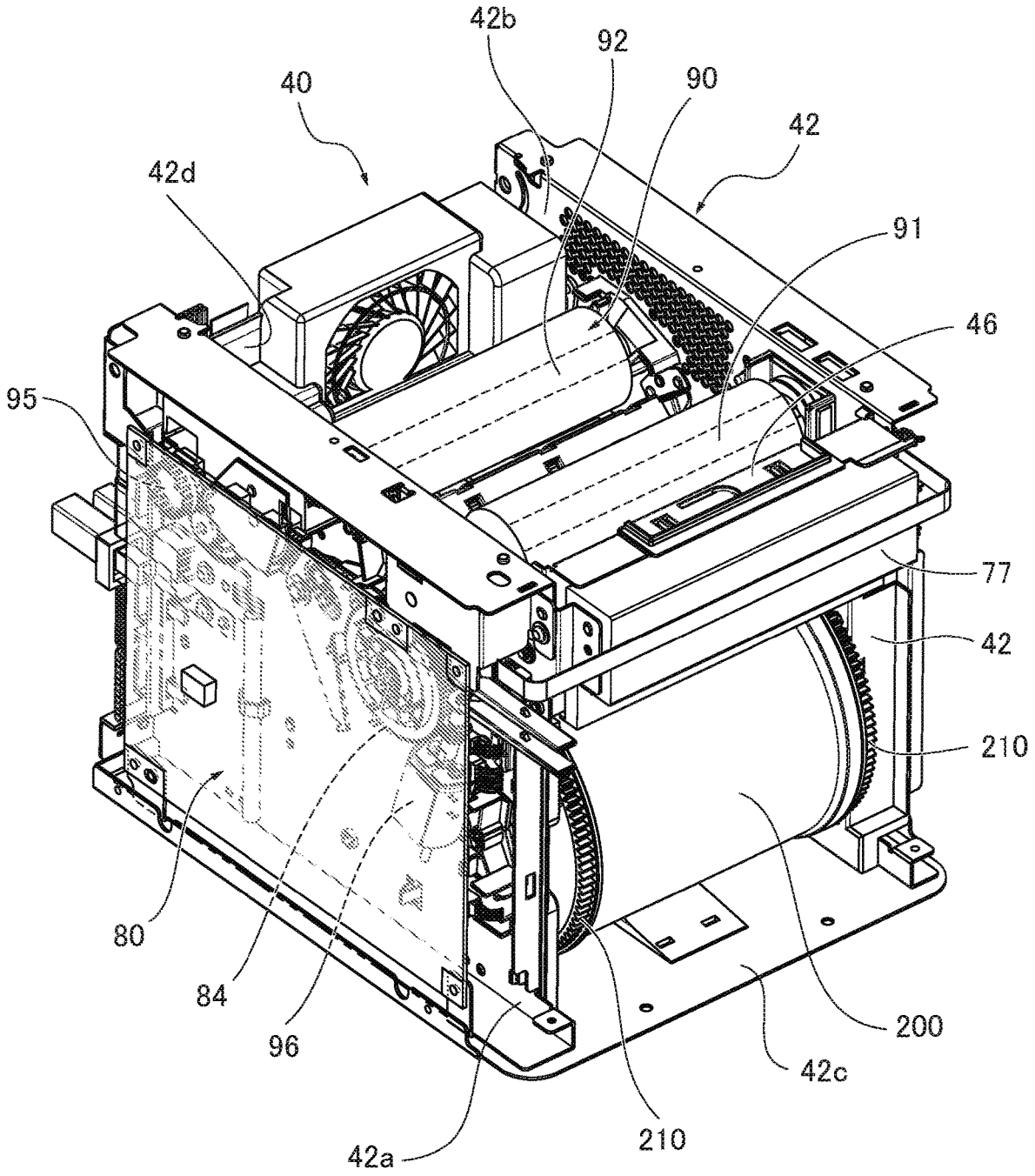
FIG. 3 is a perspective view illustrating the printer shown in FIG. 1 with the front cover, the top cover and an outer cover removed and showing a right side, a front side and an upper side thereof.
Figure 4:
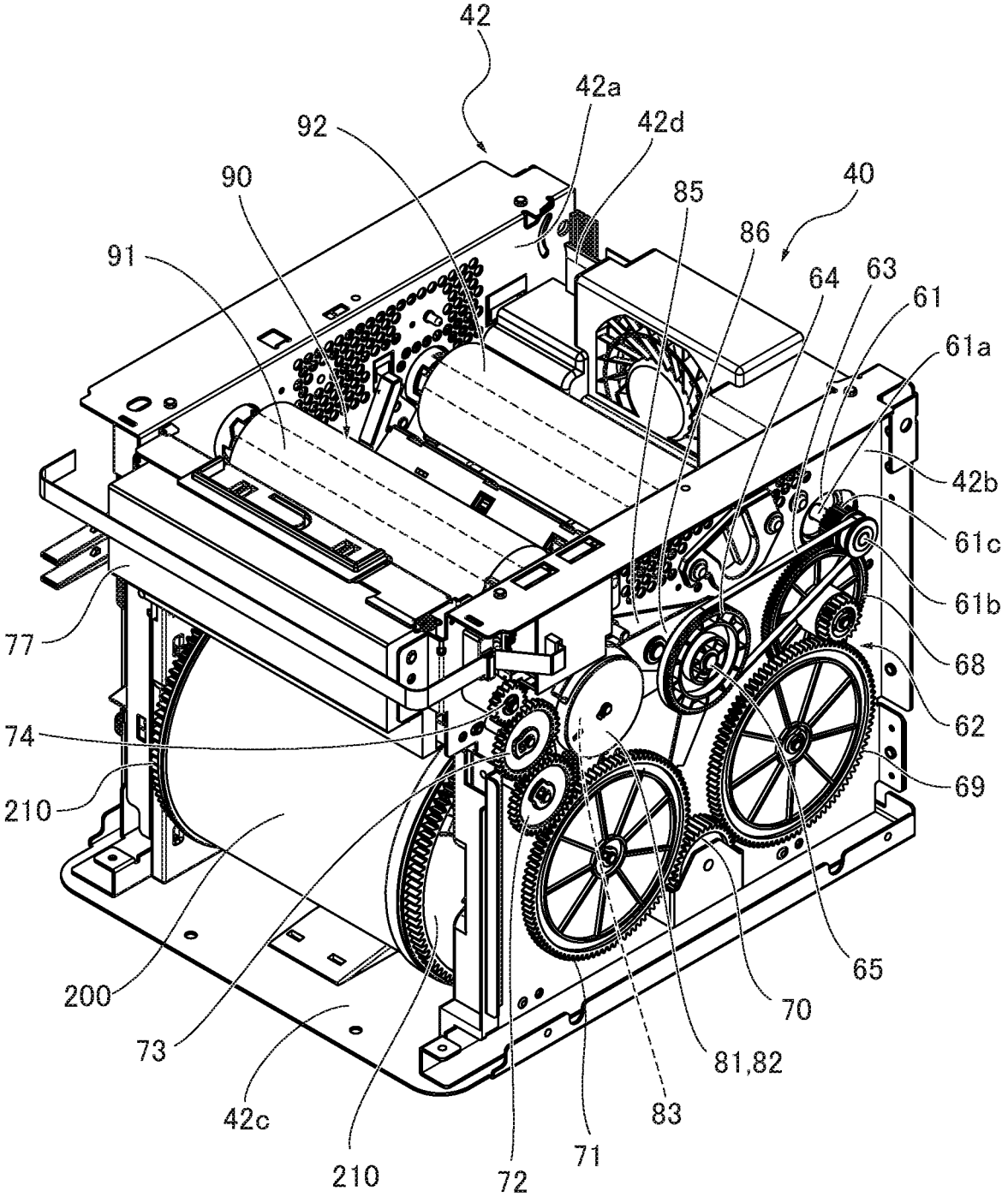
FIG. 4 is a perspective view illustrating the printer shown in FIG. 1 with the outer cover removed from the body and showing a left side, the front side and the upper side thereof.
Figure 5:
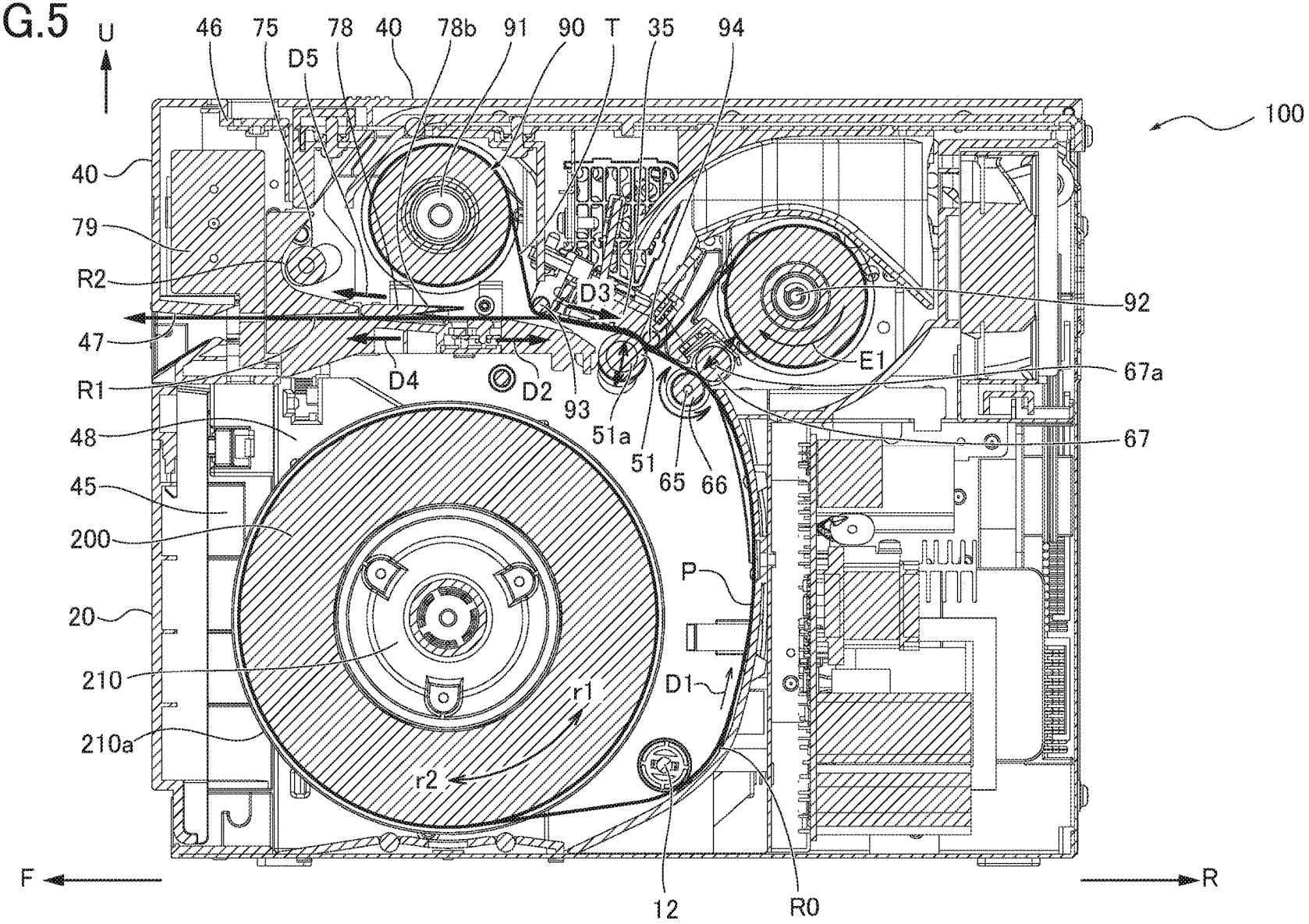
FIG. 5 is a cross-sectional view illustrating the printer shown in FIG. 1 in a front-back direction of the printer.

FIG. 3 is a perspective view illustrating the printer 100 with the front cover 20, the top cover 30 and an outer cover 41 removed and showing a right side, a front side and an upper side thereof. FIG. 4 is a perspective view illustrating the printer 100 with the outer cover 41 removed from a body 40 and showing a left side, the front side and the upper side thereof. FIG. 5 is a cross-sectional view illustrating the printer 100 shown in FIG. 1 in a front-back direction of the printer.

As shown in FIG. 1, the printer 100 is formed in a rectangular parallelepiped as a whole. The printer 100 includes the body 40, the front cover 20, and the top cover 30.

The body 40 includes a metal frame 42 and a casing consisting of the outer cover 41 which covers the frame 42. The outer cover is made of resin. The frame 42 includes a bottom plate 42*c*, a right side plate 42*a*, a left side plate 42*b*, and a rear plate 42*d*. The bottom plate 42*c* is provided in a position corresponding to a bottom of the casing. The right side plate 42*a* is provided in a position corresponding to a right side surface of the casing. The left side plate 42*b* is provided in a position corresponding to a left side surface of the casing. The rear plate 42*d* is provided in a position corresponding to a rear surface of the casing.

The front cover 20 is configured to close a front opening of the body 40 where the frame 42 is not provided. A bottom portion of the front cover 20 is rotatably supported in the vicinity of the bottom portion of the body 40. Thereby, the front cover 20 rotates about the bottom end toward the front side F to open.

The front cover 20 engages with the body 40 in a closed state shown in FIG. 1 and maintains the closed state. The engagement of the front cover 20 with the body 40 is released by a finger or the like so that the front cover 20 is opened as shown in FIG. 2.

The body 40 includes a trash box 45 in the front side thereof as shown in FIG. 2 with the front cover 20 open. The trash box 45 receives cut-off pieces, dust, and the like generated upon cutting the paper P by a cutter. The trash box 45 can be removed by sliding to the front side F. Referring to FIG. 3 to FIG. 5 with the trash box 45 removed, a paper storage portion 48 can be seen. The paper storage portion 48 stores a roll paper 200 which is formed from the elongate paper P wound in a roll. The paper P may be a photo paper that is thicker than a plain paper, for example.

The top cover 30 covers an upper opening where the frame 42 of the body 40 is not located. A rear end of the top cover 30 is rotatably supported by the upper side of the body 40 in the vicinity of a rear end of the body 40 such that the top cover 30 rotates about the rear end toward an upward direction U to open.

The top cover 30 engages with the body 40 in the closed state shown in FIG. 1 and maintains the closed state. A sliding member 46 (cover opening member) is disposed in the upper side of the body 40 in the vicinity of the front end of the body 40 and biased toward a rear side R. The engagement of the sliding member 46 with the body 40 can be released by sliding the sliding member 46 toward the front side F with a finger or the like so that the top cover 30 opens as shown in FIG. 2.

As shown in FIG. 2, a thermal head portion 35 (referred to as the head 35 hereinafter) for printing is fixed to the top cover 30. As shown in FIG. 5, the head 35 is disposed to face a platen roller 51 in the body 40 with the paper P therebetween when the top cover 30 is closed.

The body 40 includes various elements such as the paper storage portion 48 and the platen roller 51 therewithin. Specifically, the body 40 includes a drive motor 61, a power transmission member 62, an ink ribbon portion 90, a DC motor 95 which is a ribbon driving motor, a cutter portion 79, a DC motor 96 which is a switching motor, a switching mechanism 80, and a controller 98.

Further, the body 40 is provided with transfer paths for the paper P including a common transfer path R0, a discharging transfer path R1 (an example of first transfer path), and a decurl transfer path R2 (an example of second transfer path).

The common transfer path R0 is a transfer path through which the paper P unwound from the roll paper 200 is transferred. The discharging transfer path R1 is provided downstream of the common transfer path R0 in a feeding direction D1 and extends between the common transfer path R0 and an ejection port 47.

The decurl transfer path R2 is provided downstream of the common transfer path R0 in the feeding direction D1 and connected to the common transfer path R0. The decurl transfer path R2 is a transfer path different from the discharging transfer path R1 and configured to perform decurling or uncurling to reduce or eliminate the curl of the paper P.

A process where the paper P is transferred from the common transfer path R0 to the discharging transfer path R1 is referred to as a feeding process, hereinafter. Further, a process where the paper P is transferred from the common transfer path R0 to the decurl transfer path R2 and from the decurl transfer path R2 to the common transfer path R0 is referred to as an uncurling or decurling process, hereinafter.

The roll paper 200 stored in the paper storage portion 48 is formed by winding the long strip paper P around a holder 210 in a roll. The paper P unwound from the roll paper 200 is supplied through the common transfer path R0 to the discharging transfer path R1 or the decurl transfer path R2.

A pair of rollers consisting of a drive roller 66 and a pinch roller 67 are provided in the common transfer path R0 and the paper P is set between the drive roller 66 and the pinch roller 67. The drive roller 66 is fixed to a rotation axis 65 and the position of the rotation axis 65 is fixed so as not to move. On the other hand, the pinch roller 67 is movable between a first position and a second position as shown with an arrow in FIG. 5. In the first position, the pinch roller 67 is in contact with the drive roller 66 with the paper P therebetween. In the second position, the pinch roller 67 is positioned away from the drive roller 66.

In the first position where the pinch roller 67 is in contact with the drive roller 66, the rotating torque of the drive roller 66 is applied to the paper P so that the printer becomes a feedable state in which the paper P can be fed along the common transfer path R0. On the other hand, in the second position where the pinch roller 67 is away from the drive roller 66, the rotating torque of the drive roller 66 is not applied to the paper P so that the printer becomes an unfeedable state in which the paper P cannot be fed along the common transfer path R0. A switching mechanism for switching the pinch roller 67 between the feedable state and the unfeedable state will be described later.

Further, in the common transfer path R0, the ink ribbon portion 90 and the platen roller 51 are disposed downstream of the pair of rollers in the feeding direction D1.

The ink ribbon portion 90 includes a supplying reel 91, a winding reel 92, and two driven rollers 93, 94. A long strip ink ribbon T is wound around the supplying reel 91 in a roll. The ink ribbon unwound from the supplying reel 91 is then wound around the winding reel 92. The driven rollers 93, 94 place the ink ribbon T extending between the supplying reel 91 and the winding reel 92 along the paper P transferred in the common transfer path R0.

The ink ribbon T includes ink regions for yellow, magenta, and cyan, for example, and a region for an overcoat layer continuous to the ink region for cyan. These regions are repeatedly disposed in a longitudinal direction.

As shown in FIG. 3, the winding reel 92 is connected to the DC motor 95 which is disposed in the rear side of the body 40. The DC motor 95 rotates the winding reel 92 in a direction E1 shown with an arrow in FIG. 5. The DC motor 95 is controlled by the controller 98 which is installed in a single board placed on the right side of the printer.

The DC motor 95 rotates the winding reel 92 so that the ink ribbon T is unwound from the supplying reel 91 and wound around the winding reel 92. At this time, the ink ribbon T extending between the driven rollers 93, 94 is moved in a ribbon transferring direction D3.

The platen roller 51 is disposed in a position corresponding to the ink ribbon T extending between the driven rollers 93, 94. In this position, the platen roller 51 presses the paper P and the ink ribbon T against the head 35 when the top cover 30 is closed.

When the top cover 30 is closed, the head 35 does not move but the platen roller 51 is movable between a first position and a second position as shown with an arrow in FIG. 5. In the first position, the platen roller 51 is in contact with the head 35 with the paper P and the ink ribbon T therebetween. On the other hand, in the second position, the platen roller 51 is away from the head 35.

In the first position where the platen roller 51 is in contact with the head 35, the printer is set to be a printable state where the head 35 generates heat and the ink of the ink ribbon T is transferred onto the paper P so that the printing can be performed. On the other hand, in the second position where the platen roller 51 is away from the head 35, the printer is set to be an unprintable state where the ink of the ink ribbon T is not transferred onto the paper P so that the printing cannot be performed. The switching mechanism which switches the platen roller 51 between the printable state and the unprintable state will be described later.

When printing on the paper P, it is necessary to heat the head 35 and feed the paper P and the ink ribbon T. The printer 100 according to the present embodiment feeds the ink ribbon T in the transferring direction D3 and the paper P in a winding direction D2 at the same speed of the ink ribbon T. The rotation of the drive roller 66 and the pinch roller 67 feeds paper P, which will be described later.

Hereinafter, a process where printing on the paper P is performed by heating the head 35 while feeding (winding) the paper P, which has been fed to the discharging transfer path R1 in the feeding process, in the winding direction D2 toward the common transfer path R0 is referred to as the printing process.

Hereinafter, a process or state where the paper P is in the common transfer path R0 before the feeding process is referred to as the waiting process.

A flap 78 is disposed downstream of the ink ribbon portion 90 and the platen roller 51 in the feeding direction D1. In the downstream of the flap 78, the discharging transfer path R1 continuous to the ejection port 47 and the decurl transfer path R2 for decurling or uncurling to reduce the curl of the paper P are separately provided.

The flap 78 is configured to change its posture to connect the common transfer path R0 either to the discharging transfer path R1 or the decurl transfer path R2 to further feed the paper P which has been fed along the feeding direction D1.

Specifically, a front portion of the flap 78 (i.e. an end closer to the ejection port 47) is rotatably supported and a rear portion (i.e. an end closer to the platen roller 51) of the flap 78 is movable up and down (in the vertical direction).

The flap 78 switches the transfer path for the paper P to feed the paper P to the discharging transfer path R1 when the rear portion of the flap 78 is moved upward as shown in FIG. 5 or to feed the paper P to the decurl transfer path R2 when the rear portion of the flap 78 is moved downward. The switching mechanism for changing the posture of the flap 78 will be described later.

The decurl transfer path R2 is curved so as to bend the paper P in a direction opposite to a direction of the curl of the paper P generated when the paper P has been wound around the holder 210 as the roll paper 200. In addition, a decurl transfer roller 75 is provided relative to the curved portion of the decurl transfer path R2. The decurl transfer roller 75 prevents the paper P from being moved inward away from the curved portion and also provides a driving force for feeding the paper P.

When the paper P passes through the decurl transfer path R2, the paper P is bent in the direction opposite to the direction of the curl of the paper P wound around the holder 210. Thereby, the curl of the paper P generated when the paper P has been wound around the holder 210 is reduced or eliminated (i.e. the paper P is decurled or uncurled).

The cutter portion 79 is provided in the vicinity of the ejection port 47 in the discharging transfer path R1. The cutter portion 79 cuts the rear portion of the paper P which has been printed and extends from the ejection port 47. Consequently, the paper P after being printed is separated from the paper P wound around the holder 210 as the roll paper 200.

The trash box 45 is provided before (upstream of) the ejection port 47. Therefore, when a small tip portion of the paper P wound around the holder 210 as the roll paper 200 is further cut off by the cutter portion 79 after the printed paper has cut off, the small tip portion falls down into the trash box 45 without being discharged through the ejection port 47.

As shown in FIG. 4, the drive motor 61 for transferring the paper P is disposed at the rear side of the body 40 and inward of the left side plate 42*b*. The drive motor 61 is a driving source for feeding the paper P wound as the roll paper 200 in the feeding direction D1 or in an opposite direction (i.e. the winding direction D2). The drive motor 61 is a stepping motor. The drive motor 61 is controlled by the controller 98 to rotate by an angle corresponding to the number of pulses which is an output from the controller 98.

A rotation axis 61*a* of the drive motor 61 outwardly extends through the left side plate 42*b*. A pulley 61*b* and a pinion gear 61*c* are fixed to the outer portion of the rotation axis 61*a* extending through the left side plate 42*b*.

An annular transmission belt 63 is wound around the pulley 61*b* and a pulley 64. The pulley 64 which is one of the power transmission members 62 and fixed to the rotation axis 65 extending in the width direction (i.e. left-and-right direction) of the frame 42.

The rotation axis 65 is an axis to which the drive roller 66 is fixed as shown in FIG. 5. Thereby, the rotation of the drive motor 61 is transmitted to the drive roller 66 via the pulley 61*b*, the transmission belt 63, the pulley 64, and the rotation axis 65.

The drive motor 61 can rotate forward and backward. Accordingly, the paper P sandwiched between the pair of rollers consisting of the drive roller 66 and the pinch roller 67 can be fed in the feeding direction D1 and the winding direction D2.

The pinion gear 61*c* engages with a gear train as the power transmission member 62. The gear train is disposed on the left side plate 42*b*. Specifically, the gear train includes a first gear 68, a second gear 69, a third gear 70, a fourth gear 71, a fifth gear 72, a sixth gear 73, and a seventh gear 74.

The pinion gear 61*c* engages with the first gear 68. The first gear 68 engages with the second gear 69. The second gear 69 engages with the third gear 70. The third gear 70 engages with the fourth gear 71. The fourth gear 71 engages with the fifth gear 72. The fifth gear 72 engages with the sixth gear 73. The sixth gear 73 engages with the seventh gear 74.

Thereby, the rotation of the drive motor 61 is sequentially transmitted to the pinion gear 61*c*, the first gear 68, the second gear 69, the third gear 70, the fourth gear 71, the fifth gear 72, the sixth gear 73, and the seventh gear 74.

The seventh gear 74 engages with the decurl transfer roller 75 provided in the decurl transfer path R2. Thereby, the rotation of the drive motor 61 is transmitted to the decurl transfer roller 75 so that the decurl transfer roller 75 contacts the paper P in the decurl transfer path R2 to further transfer the paper P along the decurl transfer path R2.

The third gear 70 is fixed to a rotation axis (not shown) to which a clutch gear is also fixed. The clutch gear engages with a feeding gear 210*a* which is formed in an outer peripheral edge of the holder 210 for the roll paper 200 housed in the paper storage portion 48. Thereby, the rotation of the drive motor 61 is transmitted to the feeding gear 210*a* of the holder 210 to rotate the roll paper 200 so that the paper P is fed from the roll paper 200 or wound around the holder 210 as the roll paper 200.

The paper P is fed along the transfer paths mainly by the rotation of the pair of rollers consisting of the drive roller 66 and the pinch roller 67. Accordingly, the feeding speed of the paper P depends on the angular velocity of the drive roller 66.

The holder 210 of the roll paper 200 also rotates and the angular velocity of the roll paper 200 is constant. The speed at which the paper P is fed from the roll paper 200 depends on the radius of the roll paper 200 when the paper P is fed. In other words, the feeding speed of the paper P is higher when the amount of the paper P which remains as the roll paper 200 is larger and the radius of the paper P is larger. On the other hand, the feeding speed of the paper P is slower when the amount of the paper P which remains as the roll paper 200 is smaller and the radius of the paper P is smaller.

Excessive tension may be applied to the paper P or the paper P may be slackened when the feed at a constant speed by the pair of rollers (i.e. the drive roller 66 and the pinch roller 67) and the feed by the rotation of the roll paper 200 at a speed which varies depending on the remaining amount of the paper P conflict or mismatch in the transfer path for the paper P.

To this end, a clutch which absorbs the difference of the angular velocity of the roll paper 200 relative to the feeding speed of the paper P by the drive roller 66 and the pinch roller 67 is provided in the gear which engages with the feeding gear 210*a* of the holder 210. Consequently, the excessive tension and the slack of the paper P can be prevented.

It is also possible to adopt a configuration in which the third gear 70 does not engage with the feeding gear 210*a* of the holder 210 for the roll paper 200 so as not to actively rotate the roll paper 200. However, in this case, the roll paper 200 may not smoothly rotate following the feed of the paper P by the drive roller 66 and the pinch roller 67 since the weight of the roll paper 200 is relatively heavy when the remaining amount of the roll paper 200 is relatively large. If the roll paper 200 does not rotate smoothly, the feed of the paper P becomes unstable. Accordingly, it is preferable to adopt the configuration to actively rotate the roll paper 200 as in the present embodiment.

Figure 6:
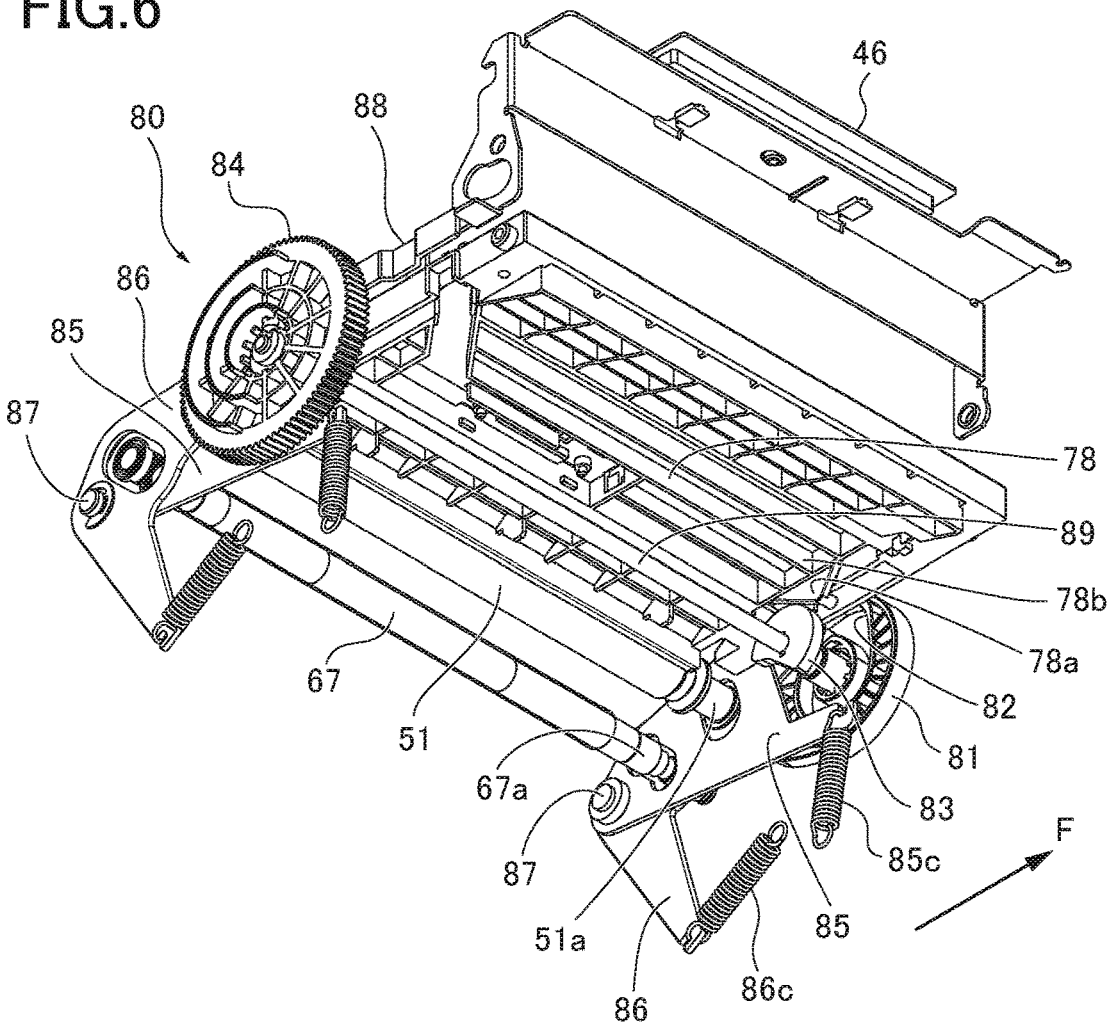
FIG. 6 is a perspective view illustrating a switching mechanism.
Figure 7:
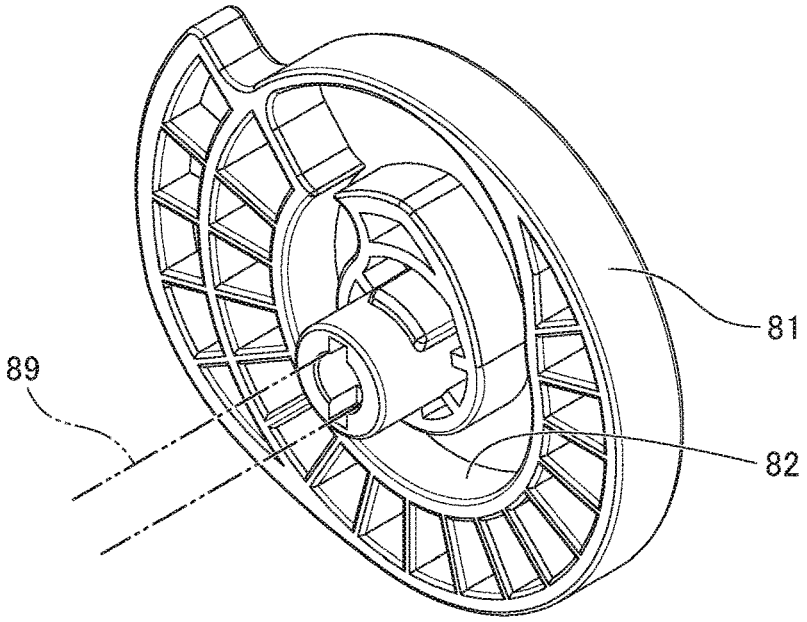
FIG. 7 is a perspective view illustrating a first cam and a second cam.
Figure 8:
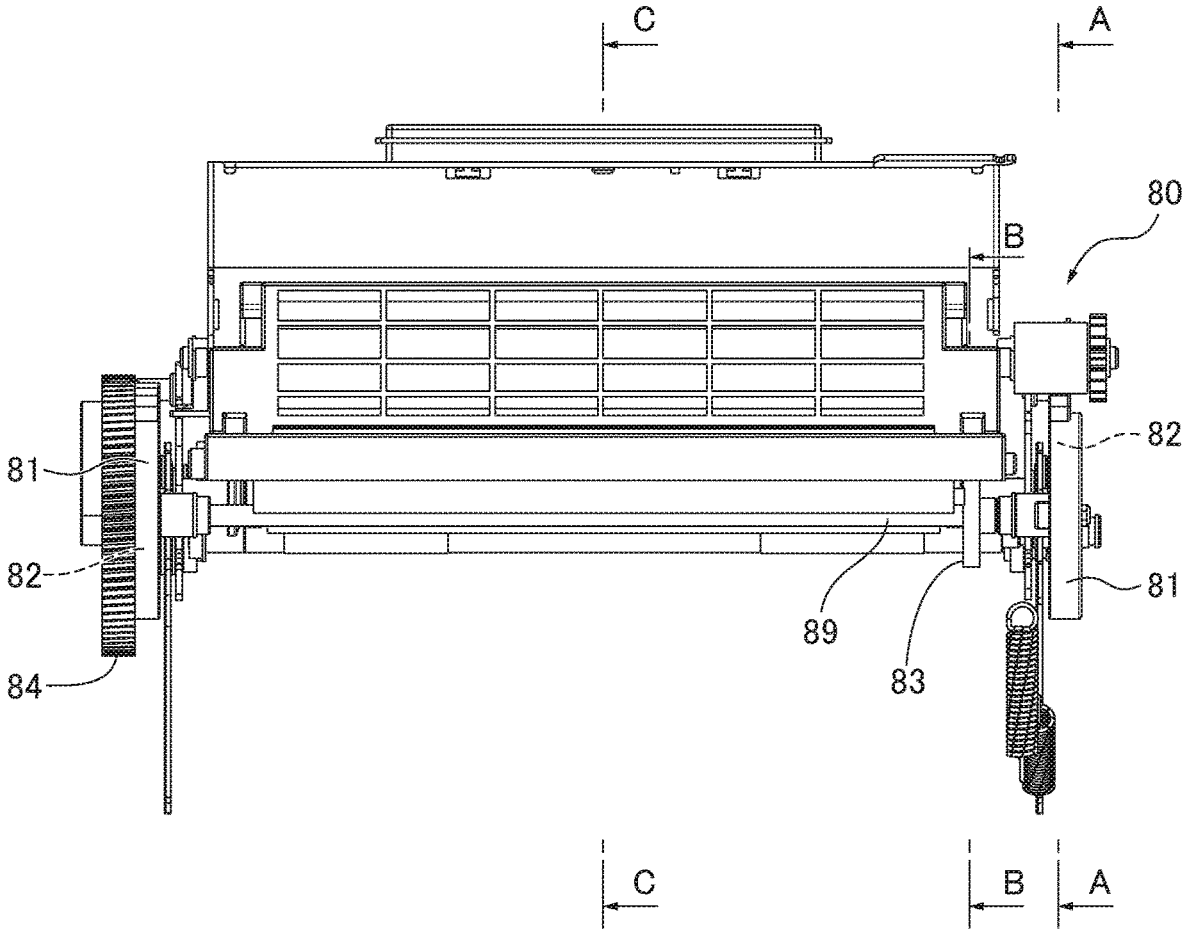
FIG. 8 is a front view illustrating the switching mechanism seen from a front side F.

FIG. 6 is a perspective view illustrating the switching mechanism 80. FIG. 7 is a perspective view illustrating a first cam 81 (first cam) and a second cam 82 (second cam). FIG. 8 is a front view illustrating the switching mechanism 80 seen from the front side F.

The switching mechanism 80 includes the first cam 81, the second cam 82, a third cam 83 (third cam), a switching gear 84, a pinch switching lever 85, and a platen switching lever 86.

As shown in FIG. 3, the switching gear 84 engages with a worm of the DC motor 96 which is the switching motor (described later) and rotates about a rotation axis 89 shown in FIG. 6 in accordance with the rotation of the worm. The switching gear 84 is provided on the right side of the body 40 along with the DC motor 96. The rotation axis 89 which rotates with the switching gear 84 extends from the right side to the left side of the body 40.

The first cam 81, the second cam 82, and the third cam 83 are fixed to the rotation axis 89 and these cams 81, 82, 83 integrally rotate with the rotation axis 89. As shown in FIG. 7, the first cam 81 and the second cam 82 are integrally formed. Specifically, the first cam 81 is formed on the outer circumferential surface as an outer cam while the second cam 82 is formed on the inner circumferential surface as an inner cam. In other words, the second cam 82 is located radially inward of the first cam 81. As shown in FIG. 4, the first cam 81 and the second cam 82 are provided on the left side of the body 40. In addition, as shown in FIG. 8, the first cam 81 and the second cam 82 are also provided with the switching gear 84 provided on the right side of the body 40.

The following description will be given with the first cam 81 and the second cam 82 provided on the right side of the body 40. It should be noted that the first cams 81 and the second cams 82 provided on both sides of the body 40 operate synchronously since the first cam 81 and the second cam 82 provided with the switching gear 84 are also fixed to the rotation axis 89.

The first cam 81 is formed with a smaller diameter portion, a larger diameter portion, and a connection or transition portion. The smaller diameter portion extends along about three-fourth of the circumference around the rotation axis 89. The smaller diameter portion has a constant radius and a relatively small outer diameter. The larger diameter portion extends along about half of about one-fourth of the circumference. The larger diameter portion has a constant radius and an outer diameter larger than that of the smaller diameter portion. The transition portion extends along about half of about one-fourth of the circumference. The transition portion has an outer diameter continuously changing to smoothly connect the smaller diameter portion and the larger diameter portion of the first cam 81.

The second cam 82 is formed with a smaller diameter portion, a larger diameter portion, and a connection or transition portion. The smaller diameter portion extends along about three-fourth of the circumference around the rotation axis 89. The smaller diameter portion has a constant radius and a relatively small inner diameter. The larger diameter portion extends along about half of about one-fourth of the circumference. The larger diameter portion has a constant radius and an inner diameter larger than that of the smaller diameter portion. The transition portion extends along about half of about one-fourth of the circumference. The transition portion has an inner diameter continuously changing to smoothly connect the smaller diameter portion and the larger diameter portion of the second cam 82.

The larger diameter portion of the first cam 81 and the larger diameter portion of the second cam 82 are formed so that rotational angle positions (phases) around the rotation axis 89 are deviated or offset. Specifically, the larger diameter portion of the first cam 81 is formed in a phase corresponding to the smaller diameter portion of the second cam 82 while the larger diameter portion of the second cam 82 is formed in a phase corresponding to the smaller diameter portion of the first cam 81.

As shown in FIG. 6, the third cam 83 is formed independently from the first cam 81 and the second cam 82. The third cam 83 is fixed to the rotation axis 89 inward of the first cam 81 and the second cam 82. The third cam 83 is formed with a larger diameter portion and a smaller diameter portion. The larger diameter portion extends along about two-thirds of the circumference around the rotation axis 89. The larger diameter portion has a constant radius and a relatively large outer diameter. The smaller diameter portion extends along a part of the range about one-third of the circumference. The smaller diameter portion has a radius smaller than that of the larger diameter portion. The smaller diameter portion and the larger diameter portion are smoothly connected.

Figure 9:
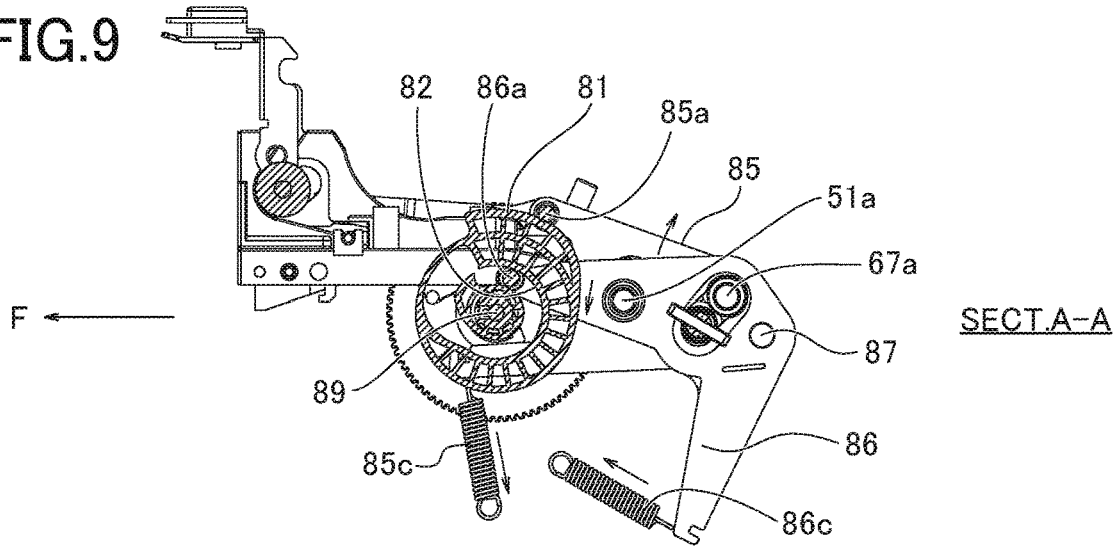
FIG. 9 is a cross-sectional view illustrating along an A-A line shown in FIG. 8 (waiting process).
Figure 10:
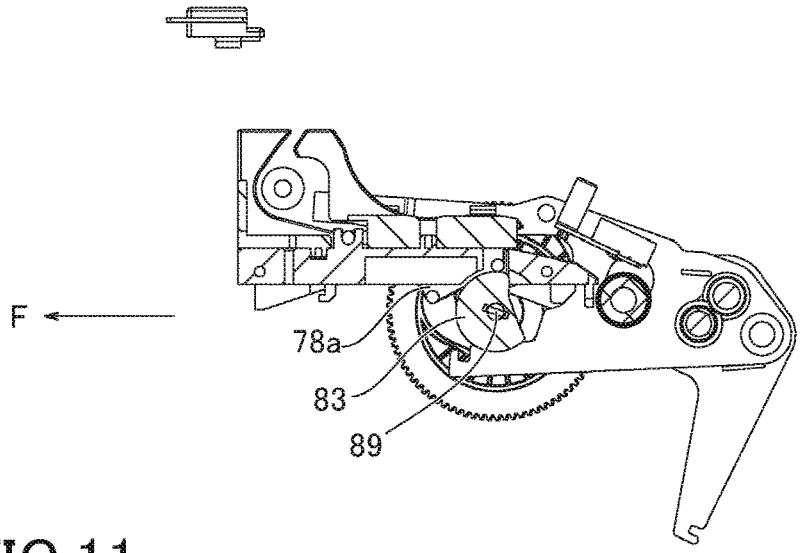
FIG. 10 is a cross-sectional view illustrating along a B-B line shown in FIG. 8 (waiting process).
Figure 11:
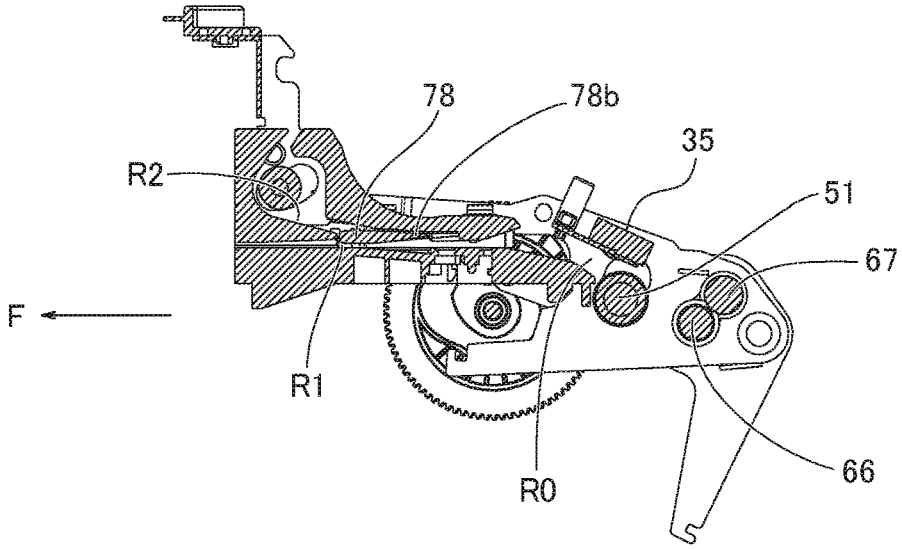
FIG. 11 is a cross-sectional view illustrating along a C-C line shown in FIG. 8 (waiting process).

FIG. 9 is a cross-sectional view along an A-A line shown in FIG. 8 and corresponds to the waiting process. FIG. 10 is a cross-sectional view along a B-B line shown in FIG. 8. FIG. 11 is a cross-sectional view along a C-C line shown in FIG. 8.

Figure 12:
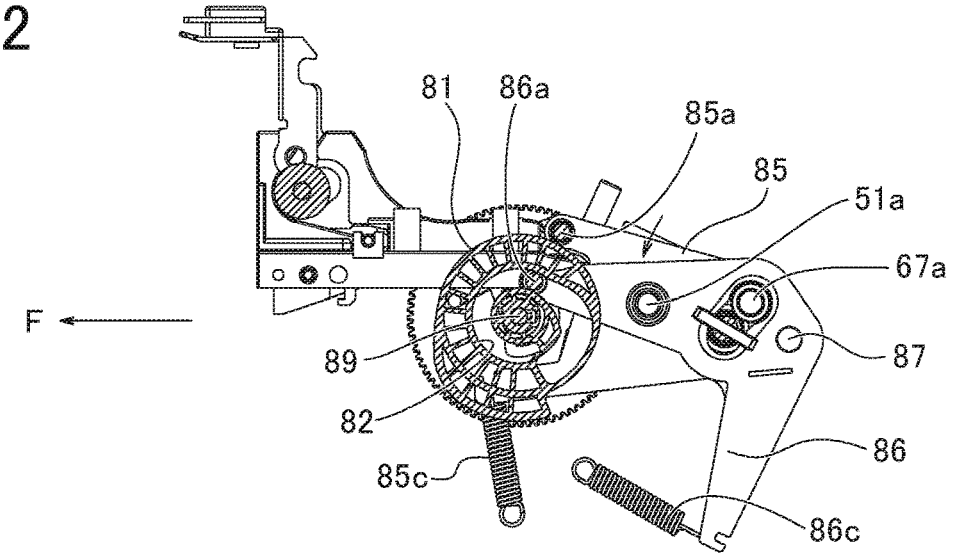
FIG. 12 is a cross-sectional view similar to FIG. 9 (feeding process).
Figure 13:
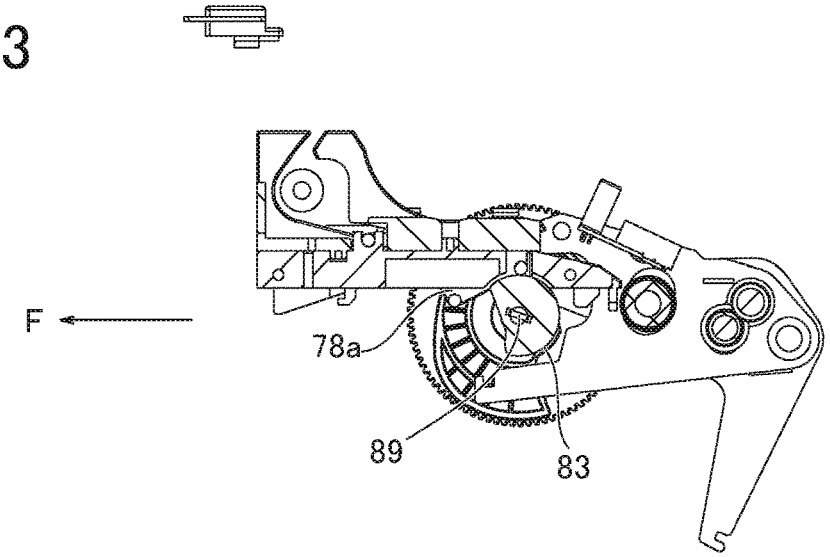
FIG. 13 is a cross-sectional view similar to FIG. 10 (feeding process).
Figure 14:
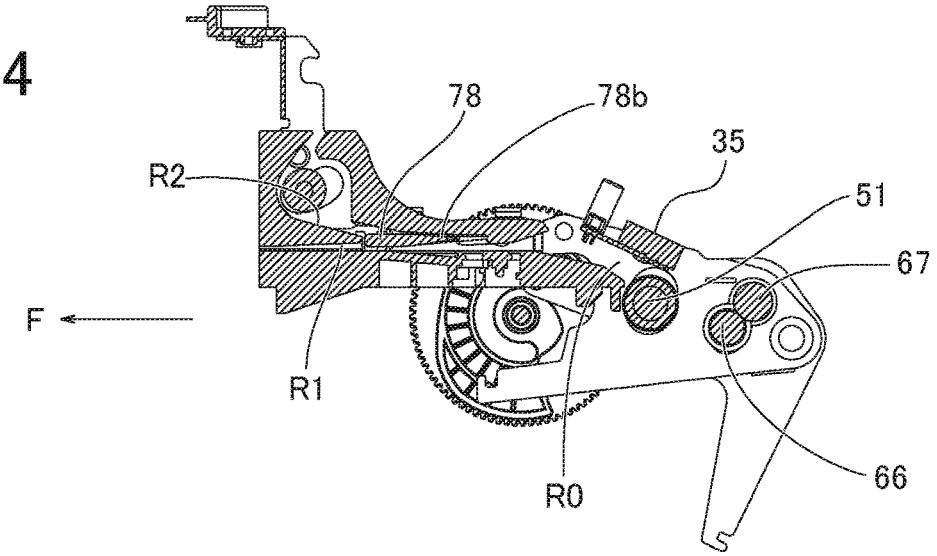
FIG. 14 is a cross-sectional view similar to FIG. 11 (feeding process).

FIG. 12 is a cross-sectional view similar to FIG. 9 and corresponds to the feeding process. FIG. 13 is a cross-sectional view similar to FIG. 10 and corresponds to the feeding process. FIG. 14 is a cross-sectional view similar to FIG. 11 and corresponds to the feeding process.

Figure 18:
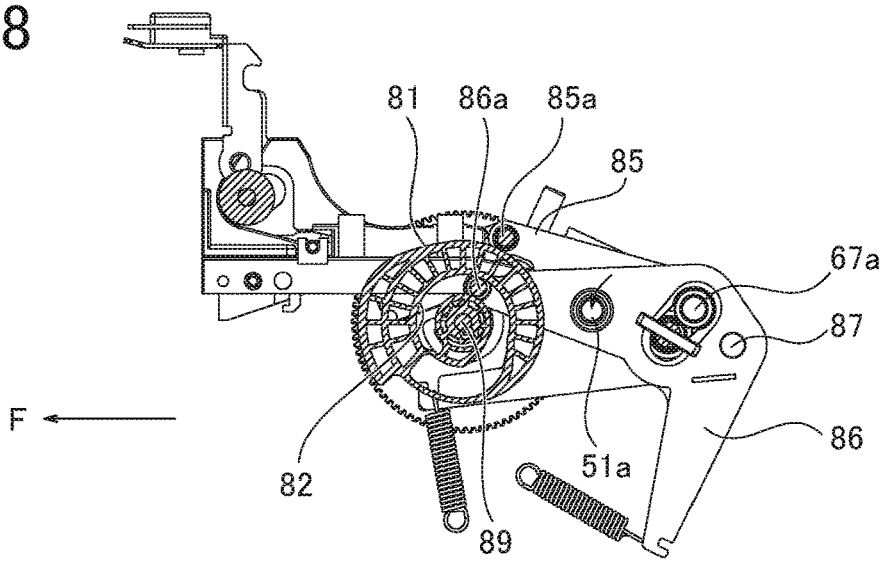
FIG. 18 is a cross-sectional view similar to FIG. 9 (decurling process).
Figure 19:
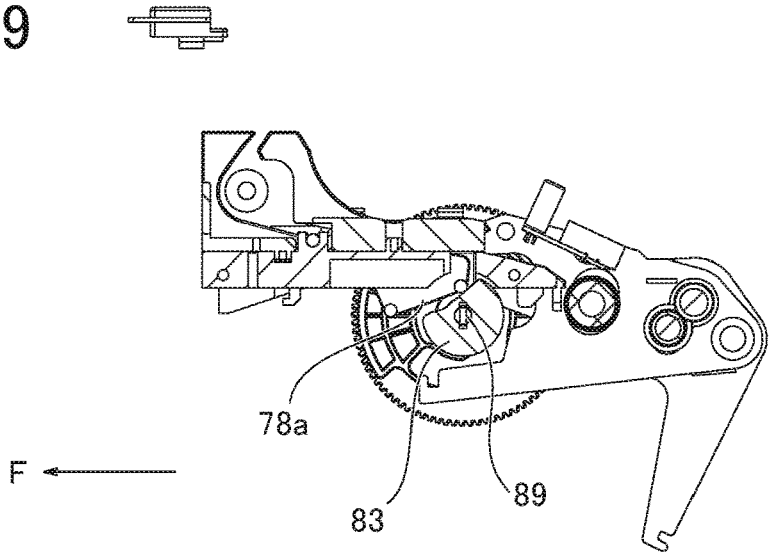
FIG. 19 is a cross-sectional view similar to FIG. 10 (decurling process).
Figure 20:
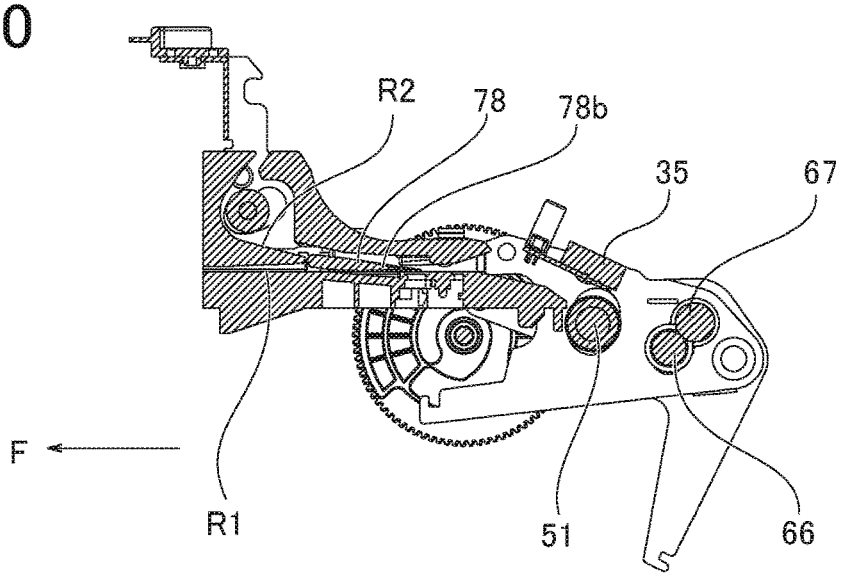
FIG. 20 is a cross-sectional view similar to FIG. 11 (decurling process).

FIG. 18 is a cross-sectional view similar to FIG. 9 and corresponds to the uncurling or decurling process. FIG. 19 is a cross-sectional view similar to FIG. 10 and corresponds to the decurling process. FIG. 20 is a cross-sectional view similar to FIG. 11 and corresponds to the decurling process.

The following description will be given with the pinch switching lever 85 and the platen switching lever 86 provided on the left side of the body 40 although the pinch switching levers 85 and the platen switching levers 86 are provided on both sides of the body 40 similar to the first cams 81 and the second cams 82.

As shown in FIG. 9, the pinch switching lever 85 includes a pin 85*a* at one end and a coil spring 85*c* at the other end relative to a rotation center 87 which is supported by the left side plate 42*b*. The pin 85*a* is provided to contact the first cam 81. The coil spring 85*c* applies elastic force in a direction where the pin 85*a* is pressed to the first cam 81 (to rotate in the counterclockwise direction shown in the figure). The pinch switching lever 85 supports a shaft 67*a* at a portion other than the rotation center 87. The shaft 67*a* rotatably supports the pinch roller 67 (see FIG. 5).

When the portion of the first cam 81 to which the pin 85*a* of the pinch switching lever 85 contacts is the larger diameter portion as shown in FIG. 9, the pinch switching lever 85 rotates about the rotation center 87 in a clockwise direction in FIG. 9 to move the shaft 67*a* in the clockwise direction. Thereby, the printer is set to the unfeedable state where the pinch roller 67 is separated from the drive roller 66. Consequently, the drive roller 66 does not feed the paper P corresponding to the waiting process.

Figure 15:
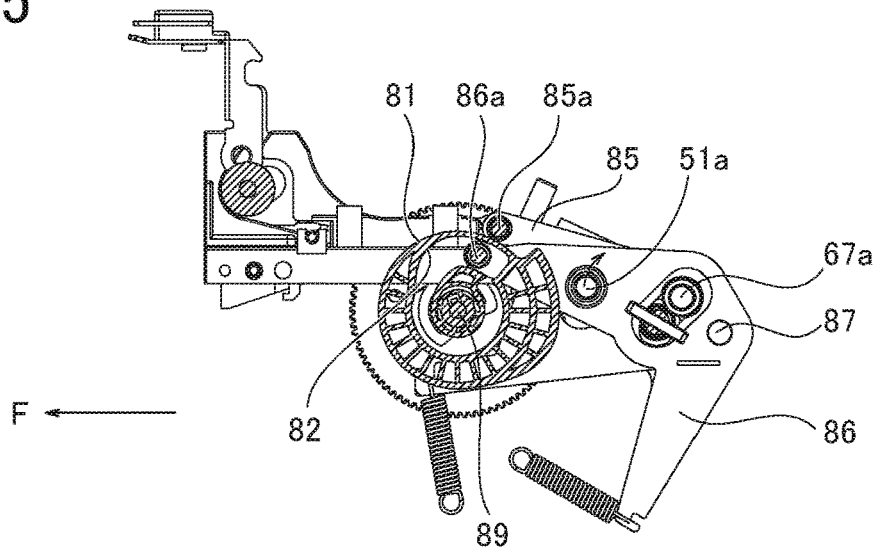
FIG. 15 is a cross-sectional view similar to FIG. 9 (printing process).

On the other hand, when the portion of the first cam 81 to which the pin 85*a* of the pinch switching lever 85 contacts is the smaller diameter portion as shown in FIGS. 12, 15, and 18, the pinch switching lever 85 rotates about the rotation center 87 in the counterclockwise direction shown in FIGS. 12, 15, and 18 to move the shaft 67*a* in the counterclockwise direction. Thereby, the printer is set to the feedable state where the pinch roller 67 is pressed against the drive roller 66. Consequently, the drive roller 66 feeds the paper P corresponding to the feeding process (FIG. 12), the printing process (FIG. 15), and the decurling process (FIG. 18).

It should be noted that the drive roller 66 does not move regardless of whether the portion of the first cam 81 to which the pin 85*a* of the pinch switching lever 85 contacts is the larger diameter portion or the smaller diameter portion.

As shown in FIG. 9, the platen switching lever 86 includes a pin 86*a* at one end and a coil spring 86*c* at the other end relative to the rotation center 87 which is supported by the left side plate 42*b*. The pin 86*a* is provided to contact the second cam 82. The coil spring 86*c* applies elastic force for pressing the pin 86*a* to the second cam 82. The platen switching lever 86 supports a shaft 51*a* at a portion other than the rotation center 87. The shaft 51*a* rotatably supports the platen roller 51 (see FIG. 5).

When the portion of the second cam 82 to which the pin 86*a* of the platen switching lever 86 contacts is the smaller diameter portion as shown in FIGS. 9, 12, and 18, the platen switching lever 86 rotates about the rotation center 87 in the counterclockwise direction in FIGS. 9, 12, and 18 to move the shaft 51*a* in the counterclockwise direction. Thereby, the printer is set to the unprintable state where the platen roller 51 is separated from the head 35. Consequently, the printing by the head 35 is not performed corresponding to the waiting process (FIG. 9), the feeding process (FIG. 12), and the decurling process (FIG. 18).

On the other hand, when the portion of the second cam 82 to which the pin 86*a* of the platen switching lever 86 contacts is the larger diameter portion as shown in FIG. 15, the platen switching lever 86 rotates about the rotation center 87 in the clockwise direction in FIG. 15 to move the shaft 51*a* in the clockwise direction. Thereby, the printer is set to the printable state where the platen roller 51 is pressed against the head 35. Consequently, the printing is performed by the head 35 corresponding to the printing process (FIG. 15).

Figure 16:
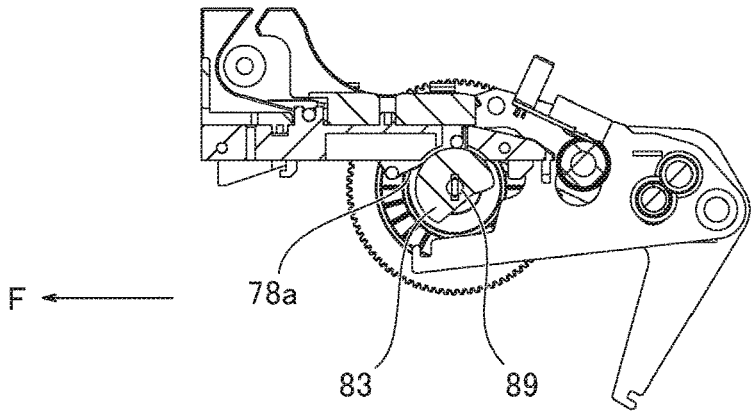
FIG. 16 is a cross-sectional view similar to FIG. 10 (printing process).
Figure 17:
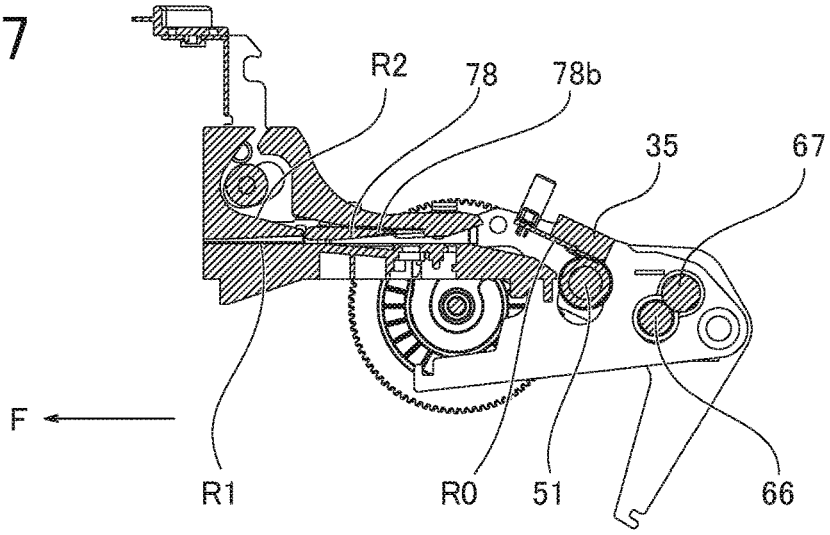
FIG. 17 is a cross-sectional view similar to FIG. 11 (printing process).

As shown in FIG. 6, the flap 78 includes a rear portion 78*b* and a convex portion 78*a* is provided at the bottom of the rear portion 78*b*. The convex portion 78*a* is provided to contact the third cam 83. When the portion of the third cam 83 to which the convex portion 78*a* contacts is the larger diameter portion as shown in FIGS. 10, 13, 16, the flap 78 rotates about the front portion as the rotation center in the counterclockwise direction in FIGS. 11, 14, 17 so that the rear portion 78*b* of the flap 78 moves upward. Thereby, the transfer path is switched to feed the paper P to the discharging transfer path R1 corresponding to the waiting process (FIG. 11), the feeding process (FIG. 14), and the printing process (FIG. 17).

On the other hand, when the portion of the third cam 83 to which the convex portion 78*a* contacts is the smaller diameter portion as shown in FIG. 19, the flap 78 rotates about the front portion as the rotation center in the clockwise direction in FIG. 20 so that the rear portion 78*b* of the flap 78 moves downward. Thereby, the transfer path is switched to transfer the paper P to the decurl transfer path R2 corresponding to the decurling process (FIG. 20).

The controller 98 controls the drives of the head 35, the drive motor 61, and the DC motors 95, 96.

Specifically, as shown in FIG. 9 to FIG. 11, in the waiting process, the controller 98 controls the DC motor 96 to rotate to switch the first cam 81, the second cam 82, and the third cam 83 to the states corresponding to the waiting process.

Further, in the waiting process, the controller 98 controls the drive motor 61 for feeding the paper P and the DC motor 95 for feeding the ink ribbon T to be in the stopped state. Moreover, the controller 98 controls not to heat the head 35 in the waiting process.

As shown in FIG. 12 to FIG. 14, in the feeding process, the controller 98 controls the DC motor 96 to rotate to switch the first cam 81, the second cam 82, and the third cam 83 to the states corresponding to the feeding process.

Further, in the feeding process, the controller 98 controls the drive motor 61 to feed the paper P in the feeding direction D1 and also controls the DC motor 95 for feeding the ink ribbon T to be in the stopped state. Moreover, the controller 98 controls not to heat the head 35 in the feeding process.

Also, in the feeding process, the controller 98 controls the drive motor 61 to feed the paper P to the winding direction D2 and also controls the DC motor 95 for feeding the ink ribbon T to be in the stopped state. Moreover, the controller 98 controls not to heat the head 35 in the feeding process.

As shown in FIG. 15 to FIG. 17, in the printing process, the controller 98 controls the DC motor 96 to rotate to switch the first cam 81, the second cam 82, and the third cam 83 to the states corresponding to the printing process.

Further, in the printing process, the controller 98 controls the drive motor 61 to feed the paper P to the winding direction D2 and also controls the DC motor 95 for feeding the ink ribbon T to be in the stopped state. Moreover, in the printing process, the controller 98 controls to heat the head 35 in accordance with contents to be printed.

In the decurling process, as shown in FIG. 18 to FIG. 20, the controller 98 controls the DC motor 96 to rotate to switch the first cam 81, the second cam 82, and the third cam 83 to the states corresponding to the decurling process.

In the decurling process, the controller 98 controls the drive motor 61 to feed the paper P in the feeding direction D1 and to feed the paper P which has been fed to the decurl transfer path R2 in the winding direction D2. Also, the controller 98 controls the DC motor 95 to feed the ink ribbon T in the transferring direction D3. Moreover, in the decurling process, the controller 98 controls not to heat the head 35 in accordance with the contents to be printed.

The first cam 81, the second cam 82, and the third cam 83 are formed with the larger diameter portions and the smaller diameter portions corresponding to the order of the waiting process (FIG. 9 to FIG. 11), the decurling process (FIG. 18 to FIG. 20), the feeding process (FIG. 12 to FIG. 14), and the printing process (FIG. 15 to FIG. 17) in accordance with the rotational position of the rotation axis 89.

In the waiting process shown FIG. 9 to FIG. 11, the printer 100 configured as above does not feed the paper P in the feeding direction D1 and the winding direction D2 and does not perform printing because of the control by the controller 98. At this time, the paper P is in the common transfer path R0.

Then, the controller 98 switches the process to the feeding process shown in FIG. 12 to FIG. 14 to feed the paper P in the feeding direction D1. The paper P is fed over the length longer than used for the printing in the feeding direction D4 along the discharging transfer path R1. At this time, the printing on the paper P is not performed.

Then, the controller 98 switches the process to the printing process shown in FIG. 15 to FIG. 17. The paper P which has been fed to the discharging transfer path R1 is fed in the winding direction D2 and the head 35 is heated to print on the paper P. At this time, the yellow portion of the ink ribbon T is pressed onto the paper P and accordingly the yellow component image among the color images to be printed is printed on the paper P.

Then, the controller 98 switches the process to the feeding process shown in FIG. 12 to FIG. 14 to feed the paper P on which the yellow component image has been printed in the feeding direction D1. The paper P is fed over the length longer than used for the printing in the feeding direction D4 along the discharging transfer path R1. At this time, the printing on the paper P is not performed.

Then, the controller 98 switches the process to the printing process shown in FIG. 15 to FIG. 17. The paper P which has been fed to the discharging transfer path R1 is fed in the winding direction D2 and the head 35 is heated to print on the paper P. At this time, the magenta portion of the ink ribbon T is pressed onto the paper P and accordingly the magenta component image among the color images to be printed is printed on the paper P. The magenta component image is aligned and superimposed on the yellow component image which has already been printed on the paper P.

Next, the controller 98 switches the process to the feeding process shown in FIG. 12 to FIG. 14 to feed the paper P on which the yellow component image and the magenta component image have been printed and superimposed in the feeding direction D1. Then, the paper P is fed over the length longer than used for the printing in the feeding direction D4 along the discharging transfer path R1. At this time, the printing on the paper P is not performed.

Then, the controller 98 switches the process to the printing process shown in FIG. 15 to FIG. 17. The paper P which has been fed to the discharging transfer path R1 is fed in the winding direction D2 and the head 35 is heated to print on the paper P. At this time, the cyan portion of the ink ribbon T is pressed onto the paper P and accordingly the cyan component image among the color images to be printed is printed on the paper P. The cyan component image is aligned and superimposed on the yellow component image and the magenta component image which have already been printed on the paper P.

Next, the controller 98 switches the process to the feeding process shown in FIG. 12 to FIG. 14 to feed in the feeding direction D1 the paper P on which the yellow component image, the magenta component image, and the cyan component image have been superimposed to generate the color image. Then, the paper P is fed over the length longer than used for the printing in the feeding direction D4 along the discharging transfer path R1. At this time, the printing on the paper P is not performed.

Then, the controller 98 switches the process to the printing process shown in FIG. 15 to FIG. 17. The paper P which has been fed to the discharging transfer path R1 is fed in the winding direction D2 and the head 35 is heated to print on the paper P. At this time, the overcoat layer of the ink ribbon T is pressed onto the paper P and the overcoat is applied to the paper P on which the yellow component image, the magenta component image, and the cyan component image have been superimposed to generate the color image.

Then, the controller 98 switches the process to the decurling process shown in FIG. 18 to FIG. 20 to feed the paper P where the overcoat has been applied to the color image in the feeding direction D1 and to feed the paper P along the decurl transfer path R2 in the feeding direction D5. At this time, the printing on the paper P is not performed. The curl of the paper P which has been fed to the decurl transfer path R2 is eliminated or reduced by passing through the decurl transfer path R2.

Then, the controller 98 switches the process to the feeding process shown in FIG. 12 to FIG. 14 to feed in the winding direction D2 the paper P where the overcoat has been applied on the color image and the curl has been eliminated or reduced. The curl of the paper P is eliminated or reduced by passing through the decurl transfer path R2 again. At this time, the printing on the paper P is not performed.

While in the feeding process shown in FIG. 12 to FIG. 14, the controller 98 switches the rotational direction of the drive motor 61 to the opposite direction to feed in the feeding direction D1 the paper P where the overcoat has been applied on the color image and the curl has been eliminated or reduced. Then, the paper P is fed along the discharging transfer path R1 in the feeding direction D4 and the printed portion of the paper P is ejected from the ejection port 47.

Next, the controller 98 stops the drive motor 61 and drives the movable blade of the cutter portion 79 to cut off the printed portion of the paper P from the paper P wound as the roll paper 200. The cutoff portion of the paper P falls down from the ejection port 47 outside the printer 100.

Then, the controller 98 switches the process to the feeding process shown in FIG. 12 to FIG. 14 to feed the paper P from which the printed portion has been cut off and which has been wound as the roll paper 200 to a position such that the tip or leading end of the paper P is located between the head 35 and the drive roller 66 in the winding direction D2. After that, the controller 98 switches the process to the waiting process. At this time, the printing on the paper P is not performed.

As described above, in the printer 100 according to the present embodiment, the first cam 81, the second cam 82, and the third cam 83 are connected to the same rotation axis 89. Accordingly, the first cam 81, the second cam 82, and the third cam 83 can be operated in synchronization with each other.

In addition, the first cam 81 changes the distance between the drive roller 66 and the pinch roller 67 to switch the printer between the feedable state and the unfeedable state of the paper P. Further, the second cam 82 changes the distance between the head 35 and the platen roller 51 to switch the printer between the printable state and the unprintable state relative to the paper P. Moreover, the third cam 83 changes the posture of the flap 78 to switch the transfer path for the paper P between the discharging transfer path R1 and the decurl transfer path R2.

Accordingly, in the printer 100 according to the present embodiment, three types of switching can be performed in synchronization only by the controller 98 controlling one DC motor 96 to control the rotational angle of the switching gear 84. The three types of switching include the switching between the feedable state and the unfeedable state of the paper P, the switching between the printable state and the unprintable state relative to the paper P, and the switching of the transfer paths for the paper P.

Thereby, the printer 100 according to the present embodiment can perform the switching between the feedable state and the unfeedable state of the paper P, the switching between the printable state and the unprintable state relative to the paper P, and the switching of the transfer paths for the paper P with reduced cost compared to the printer separately provided with the switching mechanisms and the drive sources.

In addition, the printer 100 according to the present embodiment does not require additional spaces for the switching mechanisms and the drive sources separately provided. Therefore, the printer can be downsized by eliminating such spaces.

In particular, it is significantly effective to synchronize the switching of the transfer paths for the paper P and the switching between the printing process and the feeding process.

In the printer 100 according to the present embodiment, the two transfer paths, i.e. the discharging transfer path R1 and the decurl transfer path R2 are switched. However, the two transfer paths to be switched in the printer according to the present disclosure are not limited to the discharging transfer path and the decurl transfer path. Two transfer paths other than the discharging transfer path and the decurl transfer path may be switched.

In addition, the number of the transfer paths to be switched in the printer according to the present disclosure is not limited to two but may be three or more than four.

In the printer 100 according to the present embodiment, the first cam 81 moves the pinch roller 67 relative to the drive roller 66 to change the distance between the pair of rollers consisting of the drive roller 66 and the pinch roller 67. However, in order to change the distance between the pair of rollers consisting of the drive roller 66 and the pinch roller 67, a configuration to move the drive roller 66 relative to the pinch roller 67 may be adopted.

The position of the drive roller 66, to which the driving force is transmitted, relative to other mechanisms for transmitting the driving force is more precisely set compared to the pinch roller 67. Accordingly, from the viewpoint of maintaining accuracy for the positional relationship, a configuration to move the pinch roller 67 that does not require such an accurate positional relationship is more advantageous than the configuration to move the drive roller 66 that requires a more accurate positional relationship.

Further, in the printer 100 according to the present embodiment, the second cam 82 moves the platen roller 51 relative to the head 35 to change the distance between the head 35 and the platen roller 51. However, a configuration to move the head 35 relative to the platen roller 51 may be adopted to change the distance between the head 35 and the platen roller 51.

In the printer 100 according to the present embodiment, the first cam 81, the second cam 82, and the third cam 83 that operate in synchronization with each other are formed corresponding to the order of the waiting process, the decurling process, the feeding process, and the printing process in accordance with the rotational position of the rotation axis 89. Thereby, the rotational angle of the rotation axis 89 can be reduced and the time required for switching the processes can be shortened when switching between the feeding process and the printing process since the feeding process and the printing process are adjacent to each other.

Similarly, in the printer 100, the rotation angle of the rotation axis 89 can be reduced and the time required for the switching the processes can be shortened when switching between the feeding process and the decurling process since the feeding process and the decurling process are adjacent to each other.

Figure 21:
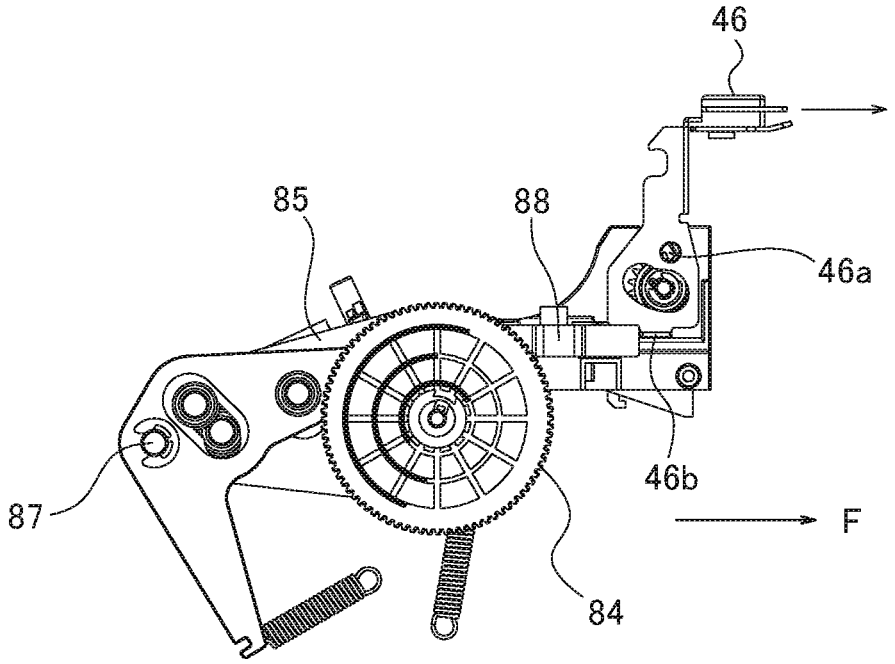
FIG. 21 is a right side view illustrating a positional relationship between a stopper (cover opening restriction member) disposed in a pinch switching lever and a sliding member (cover opening member) in processes other than the waiting process (i.e. printing process, feeding process, and decurling process).
Figure 22:
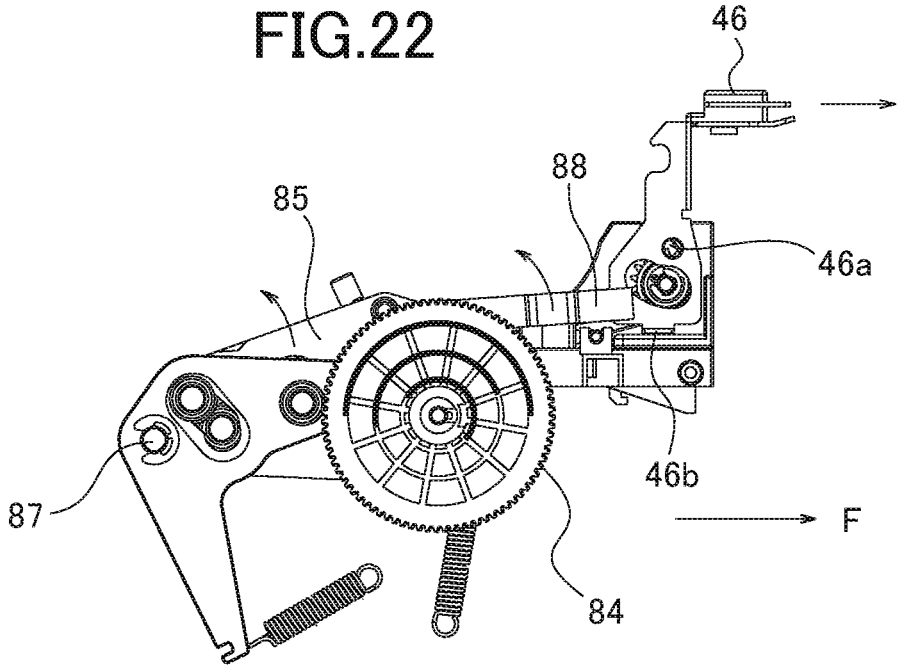
FIG. 22 is a right side view corresponding to FIG. 21 and illustrating the positional relationship between the stopper and the sliding member in the waiting process.
Figure 23:
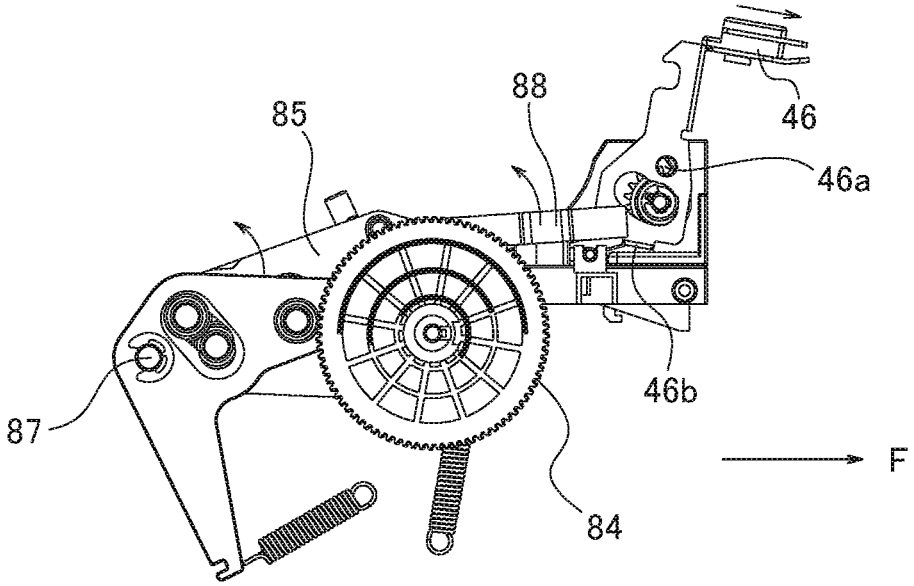
FIG. 23 is a right side view corresponding to FIG. 21 and illustrating the movement of the sliding member in the waiting process.

FIG. 21 is a right side view illustrating a positional relationship between a stopper 88 (cover opening restriction member) disposed in the pinch switching lever 85 and a sliding member 46 (cover opening member) in processes other than the waiting process (i.e. printing process, feeding process, and decurling process). FIG. 22 is a right side view corresponding to FIG. 21 and illustrating the positional relationship between the stopper 88 and the sliding member 46 in the waiting process. FIG. 23 is a right side view corresponding to FIG. 21 and illustrating the movement of the sliding member 46 in the waiting process.

In the printer 100 according to the present embodiment, the engagement of the top cover 30 with the body 40 can be released by sliding the sliding member to the front side F with a finger or the like to open the top cover 30 as shown in FIG. 2.

In the printer 100 according to the present embodiment, the pinch switching lever 85 supported on the side of the right side plate 42*a* is provided with the stopper 88 extending to the front side F as shown in FIG. 21. When the pinch switching lever 85 is in the posture in the processes other than the waiting process (i.e. the printing process, the feeding process, the decurling process), the front end of the stopper 88 abuts the bottom end of the sliding member 46. Accordingly, the stopper 88 prevents or restricts the sliding member 46 from rotating about a rotation center 46*a* to slide to the front side F.

Thereby, when the paper P is moving, for example, when the printer 100 is in the printing process, the feeding process or the decurling process, the top cover 30 is prevented to be opened.

On the other hand, when the printer 100 is in the waiting process, the pinch switching lever 85 is inclined and the front end of the stopper 88 is positioned upward from the bottom end of the sliding member 46 as shown in FIG. 22. Accordingly, the stopper 88 does not prevent or restrict the sliding member 46 from rotating about the rotation center 46*a*. Accordingly, the top cover 30 of the printer 100 can be opened only in the waiting process but cannot be opened during the operation of the printer 100 other than the waiting process.

The printer 100 according to the present embodiment is the sublimation type thermal transfer printer. However, the printer according to the present embodiment is not limited to the sublimation type thermal transfer printer and the present disclosure may be applied to a dot impact printer, a thermal printer, and an inkjet printer, for example.

What is claimed is:

1. A printer comprising:

a first cam that is configured to change a distance between a pair of rollers that are provided opposite to each other with a paper therebetween, wherein at least one of the pair of rollers is configured to feed the paper along a transfer path by its rotation, a second cam that is configured to change a distance between a printing head portion for printing on the paper and a platen roller that is provided opposite to the printing head portion with the paper therebetween, and a third cam that is configured to switch the transfer path for the paper to one of a first transfer path and a second transfer path that are formed as different transfer paths, wherein the first cam, the second cam, and the third cam are connected to a same rotation axis, wherein the first transfer path is a transfer path continuous to an ejection port for ejecting the paper outside, and the second transfer path is a decurl transfer path for decurling to reduce a curl of the paper, wherein the first cam is further configured to switch the printer between a feedable state where the pair of rollers contact each other and an unfeedable state where the pair of rollers are separated from each other, wherein the second cam is further configured to switch the printer between a printable state where the printing head portion and the platen roller contact each other and an unprintable state where the printing head portion and the platen roller are separated from each other, the printer further comprising:

a printing process for feeding the paper and printing on the paper, a feeding process for feeding the paper without printing on the paper, a decurling process for feeding the paper to the second transfer path, and a waiting process before printing on the paper not to feed the paper, wherein the first cam, the second cam, and the third cam are provided in accordance with a rotational angle of the rotation axis such that in the printing process, the first cam switches the printer to the feedable state, the second cam switches the printer to the printable state, and the third cam switches the transfer path to the first transfer path, in the feeding process, the first cam switches the printer to the feedable state, the second cam switches the printer to the unprintable state, and the third cam switches the transfer path to the first transfer path, in the decurling process, the first cam switches the printer to the feedable state, the second cam switches the printer to the unprintable state, and the third cam switches the transfer path to the second transfer path, and in the waiting process, the first cam switches the printer to the unfeedable state, the second cam switches the printer to the unprintable state, and the third cam switches the transfer path to the first transfer path or the second transfer path.

2. The printer according to claim 1, wherein the first cam, the second cam, and the third cam correspond to an order of the waiting process, the decurling process, the feeding process, and the printing process in accordance with a rotational position of the rotation axis.

3. The printer according to claim 1, further comprising:

a cover opening member that is configured to move in accordance with an operation to open a cover of a casing, and a cover opening restriction member that is configured to restrict the cover opening member from moving in accordance with the operation to open the cover when the first cam is in the feedable state.

* * * * *